US005762587A

United States Patent [19]

Dalebout et al.

[11] Patent Number: 5,762,587

[45] Date of Patent: Jun. 9, 1998

[54] EXERCISE MACHINE WITH ADJUSTABLE-RESISTANCE, HYDRAULIC CYLINDER

[75] Inventors: William T. Dalebout, Logan, Utah; Carlo Ferrari, Alicante, Spain

[73] Assignee: Icon Health & Fitness, Inc., Logan, Utah

[21] Appl. No.: 382,344

[22] Filed: Feb. 1, 1995

[51] Int. Cl.[6] ..... A63B 23/04

[52] U.S. Cl. ..... 482/53; 482/52; 482/111; 482/112

[58] Field of Search ..... 188/266, 319, 188/285, 315; 417/226; 482/53, 52, 118, 72, 95

[56] References Cited

U.S. PATENT DOCUMENTS

| | | |
|---|---|---|
| D. 227,304 | 6/1973 | Smith et al. . |
| 2,079,594 | 7/1937 | Clem . |
| 2,261,155 | 11/1941 | Hedrick . |
| 2,553,912 | 11/1951 | Gervais . |
| 2,771,968 | 1/1956 | Mercier . |
| 3,465,592 | 9/1969 | Perrine . |
| 3,529,474 | 9/1970 | Olson et al. . |
| 3,963,101 | 6/1976 | Stadelmann et al. . |
| 3,966,182 | 6/1976 | Stadelmann et al. . |
| 4,093,196 | 6/1978 | Bauer . |
| 4,563,001 | 1/1986 | Terauds . |
| 4,645,200 | 2/1987 | Hix . |
| 4,685,669 | 8/1987 | DeCloux . |
| 4,733,858 | 3/1988 | Lan . |
| 4,736,944 | 4/1988 | Johnson et al. . |
| 4,796,881 | 1/1989 | Watterson . |
| 4,813,667 | 3/1989 | Watterson . |
| 4,830,362 | 5/1989 | Bull . |

(List continued on next page.)

FOREIGN PATENT DOCUMENTS

| | | |
|---|---|---|
| 0095226A2 | 11/1983 | European Pat. Off. . |
| 2215119 | 11/1973 | Germany . |
| 2225342 | 12/1973 | Germany . |
| 2408052 | 8/1975 | Germany . |
| 240855 | 8/1975 | Germany . |
| 391220A1 | 11/1989 | Germany . |
| 7810374 | 4/1980 | Netherlands . |
| 1505702 | 3/1978 | United Kingdom . |
| 8101662 | 6/1981 | WIPO . |

OTHER PUBLICATIONS

Pro–Form® Ascent Dual Action Motivational Stepper Advertising Slick.
Pro–Form® Club SX[1] Independent Stepping Action Motivational Club Stepper Advertising Slick.
Pro–Form® Free Step Independent Stepping Action Adjustable Resistance Advertising Brochure.
Lifestyler SX[1] Advertising Brochure.
Pro–Form® Step USA II Advertising Brochure.
Weslo Summit ST100 Advertising Brochure.
Pro–Form® Air Walker 520 AW Advertising Slick.
Pro–Form® 540 Advertising Brochure.
Weslow® Ascent™ 735 Advertising Slick.
Pro–Form 820 Advertising Slick.
Weslo Ascent 2010 Advertising Brochure.

*Primary Examiner*—Jerome Donnelly
*Attorney, Agent, or Firm*—Trask, Britt & Rossa

[57] ABSTRACT

An exercise machine has a frame, one or more levers pivotally attached to the frame for a user to move in the performance of exercise movements, at least one fluid cylinder connected between the frame and each lever(s) for offering resistance to the exercise movements, and means for adjustment of the resistance of the cylinder by changing the flow rate of fluid in a channel therein. In an illustrated embodiment, the flow rate of the cylinder is varied by rotation of a gear collar affixed to the cylinder, and the adjustment means includes a gear engaged with the gear collar(s) of the cylinder(s), a drive shaft affixed to the gear, and drive means operably associated with the drive shaft. Preferred drive means comprise a motor connected to an electronic controller; however, an alternative embodiment employs a mechanical drive linkage to a knob or crank. Also described are stairclimbing exercise machines incorporating the adjustable-resistance cylinder.

19 Claims, 7 Drawing Sheets

U.S. PATENT DOCUMENTS

| | | | |
|---|---|---|---|
| 4,838,543 | 6/1989 | Armstrong et al. . | |
| 4,880,230 | 11/1989 | Cook . | |
| 4,913,396 | 4/1990 | Dalebout et al. . | |
| 4,921,242 | 5/1990 | Watterson . | |
| 4,934,690 | 6/1990 | Bull | 482/53 |
| 4,940,233 | 7/1990 | Bull et al. . | |
| 4,981,199 | 1/1991 | Tsai . | |
| 5,004,224 | 4/1991 | Wang . | |
| 5,058,882 | 10/1991 | Dalebout et al. . | |
| 5,062,627 | 11/1991 | Bingham . | |
| 5,108,093 | 4/1992 | Watterson . | |
| 5,129,450 | 7/1992 | Hung | 482/53 |
| 5,178,599 | 1/1993 | Scott . | |
| 5,180,353 | 1/1993 | Snyderman . | |
| 5,183,448 | 2/1993 | Wang . | |
| 5,183,449 | 2/1993 | DeCloux | 482/53 |
| 5,188,577 | 2/1993 | Young et al. . | |
| 5,190,505 | 3/1993 | Dalebout et al. . | |
| 5,236,407 | 8/1993 | Wang | 482/53 |
| 5,254,059 | 10/1993 | Arthur et al. . | |
| 5,256,118 | 10/1993 | Chen | 482/53 |
| 5,261,867 | 11/1993 | Chen . | |
| 5,299,994 | 4/1994 | Chen | 482/52 |
| 5,316,534 | 5/1994 | Dalebout et al. . | |
| 5,320,588 | 6/1994 | Wanzer et al. . | |
| 5,336,142 | 8/1994 | Dalebout et al. . | |
| 5,370,592 | 12/1994 | Wu | 482/53 |
| 5,403,254 | 4/1995 | Lundin et al. | 482/52 |

EXERCISE MACHINE WITH ADJUSTABLE-RESISTANCE, HYDRAULIC CYLINDER

BACKGROUND OF THE INVENTION

1. Field of the Invention

The invention relates to adjustable resistance exercise machines, and particularly to a stepping exercise machine with an adjustable, hydraulic cylinder.

2. State of the Art

Stepping exercise machines or steppers for performing stepping exercises are known. Typically steppers have a pair of spaced-apart, generally-aligned levers or pedals upon which a user places his or her feet and steps downwardly. Resistance is typically interposed to resist downward movement of the pedals and in turn regulate the speed and/or difficulty of the exercise being performed. Resistance to downward movement can be controlled by, for example, hydraulic cylinders such as that shown in U.S. Pat. No. 5,336,142 (Dalebout, et al.).

Hydraulic cylinders of the kind having a piston rod terminating in a piston head slidably disposed in a double-walled, elongated tube having closed ends are known for use as resistance elements for exercise machines. U.S. Pat. Nos. 4,541,627 (MacLean, et al.), 4,621,623 (Wang), 4,572,500 (Weiss), 4,477,071 (Brown, et al.), 4,448,412 (Brentham), 5,277,677 (Terauds), and 5,290,211 (Stearns) all disclose examples of exercise machines having hydraulic cylinders as resistance elements. In a typical hydraulic cylinder, there is a fluid such as oil in the inner tube, on both sides of the piston head, and in the space between the inner and outer walls. The end of the piston rod distal to the piston head extends slidably and sealingly through one closed end of the cylinder. The hydraulic cylinder is connected between a fixed support and a movable exercise member. The distal end of the piston rod may be attached to the fixed support, and the end of the tube nearest the piston head affixed to the movable member. The opposite arrangement is also possible. In either case, movement of the exercise member relative to the support exerts force on the piston to slide the piston head within the chamber.

In most steppers, it is desirable that the effort required to move the movable member be variable, so that different users may choose different degrees of effort, and/or so that a single user can increase or decrease the exercise difficulty at will. For exercise machines having a hydraulic cylinder, such adjustment of effort generally is provided by changing the attachment position of one end of the cylinder, relative to the attachment point of the other end. Changing the attachment changes the effective length of the vector along which the movement of the member exerts force to slide the piston in the tube, and thus changes the amount of effort required by the user to move the member. U.S. Pat. Nos. 5,336,142 (Dalebout, et al.), 5,180,353 (Snyderman), 5,188,577 (Young, et al.), and 5,190,505 (Dalebout, et al.) each disclose a stairclimbing-type exercise machine having hydraulic cylinders as resistance elements with a mechanism to adjust the difficulty of moving the pedals.

Consequently, a need remains for means to adjust the resistance offered by a hydraulic cylinder, which does not require such physical repositioning of an attachment point of the cylinder. A need further remains for such means which can be electronically activated via switches, a keypad, or the like, these being easily accessed by a user during an exercise session.

SUMMARY

An exercise machine has a frame and one or more levers pivotally attached to the frame for a user to move in the performance of exercise movements. A resistance assembly is mounted to resist movement of the lever. The resistance assembly has an external adjustment means to vary the resistance. An operation means is positioned to operate the external adjustment means. Drive means are operably linked to the operation means to operate the external adjustment means.

The resistance means is preferably a fluid cylinder connected between the frame and the lever(s) for offering resistance to the exercise movements. The external adjustment means may be a collar associated with a cylinder to vary the resistance. The operation means may be a disc positioned to frictionally engage the collar or a gear positioned to mesh with the collar.

In a preferred embodiment the operation means is a motor that drives a gear which meshes with the collar. Means such as a switch or controller are disposed on the frame and communicatively linked to control the motor.

The illustrated exercise machines are stairclimbing exercise machines. These stairclimbing machines each include a frame, two pedal levers, and two adjustable resistance cylinders. That is, one cylinder is linked between each of the pedal levers and the main frame. In the preferred embodiments, the gear drive means is a single motor and motor shaft gear positioned to simultaneously engage the gear collars of both the cylinders. The motor is in turn communicatively linked to a switch which could be an electronic keypad disposed on the upright member or on handle means attached thereto, and operable by a user while standing/stepping on the pedal levers.

Certain embodiments of the stairclimbing exercise machine further include a vertically offset pulley lining the piston shaft of the cylinder to the pedal lever on which a user steps while performing the exercise. The offset pulley linkage reduces strain and wear on the cylinder(s), gear drive and remote linkage mechanism resulting from the operation of the lever(s). A further embodiment of the stairclimbing machine has an arrangement in which the pedal levers are mounted to the base on one side of the upright member, with the pedals themselves extending to the opposite side of the upright member, and the resistance assembly is arranged with the cylinders mounted to the base near the pedal lever attachment point, and oriented in quasi-parallel relationship to the pedal levers in their raised position.

A fluid, cylinder, resistance assembly useful in the exercise machines of the invention is configured to provide adjustment of the inherent cylinder resistance, and exercise machines incorporating the cylinder resistance assembly. The cylinder resistance assembly includes one or more fluid cylinders each including a fluid flow channel wherein a rate of fluid flow determines an inherent resistance, and each being configured for adjustment of said inherent resistance by variation of the fluid flow rate. Resistance adjustment means are operably associated with the cylinder(s) for effecting variation of the flow rate, and drive means are operably linked to operate the resistance adjustment means. In one embodiment, the cylinder(s) each include a rotatable collar and are configured such that rotation of said collar adjusts said flow rate, the resistance adjustment means comprises gear means drivingly engaged with the collar, and the drive means comprises a drive shaft fixed either to a motor, or to a mechanical linkage terminating in a knob, the mechanical linkage being configured such that rotation of the knob is translated into rotation of the gear means. Alternatively, the drive means may comprise a crank fixed to rotate the gear means, and having a handle portion for gripping by a user.

BRIEF DESCRIPTION OF THE DRAWINGS

In the drawings, which illustrate what is presently regarded as the best mode for carrying out the invention, and wherein like parts are designated by like reference numerals.

DETAILED DESCRIPTION OF THE ILLUSTRATED EMBODIMENTS

Figure 1A:
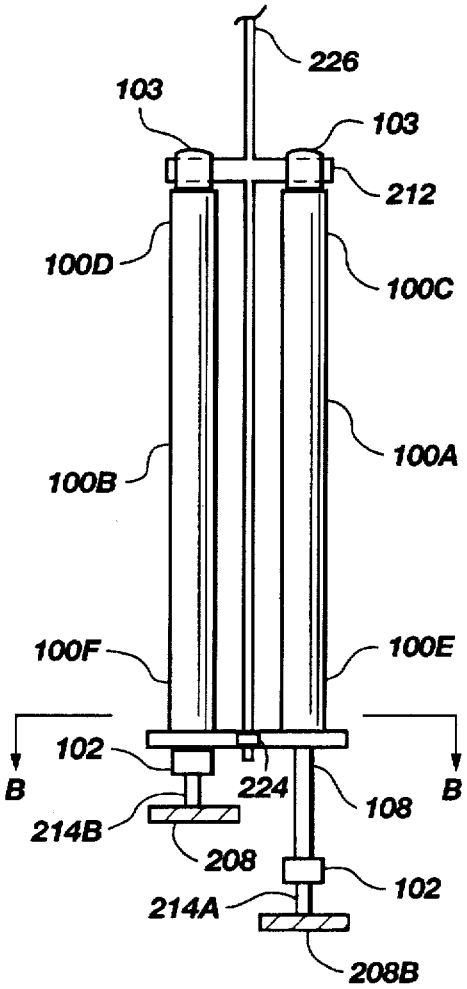
FIG. 1A is an enlarged front view detail showing the resistance cylinders of the stairclimbing machine in FIG. 1A.
Figure 1:
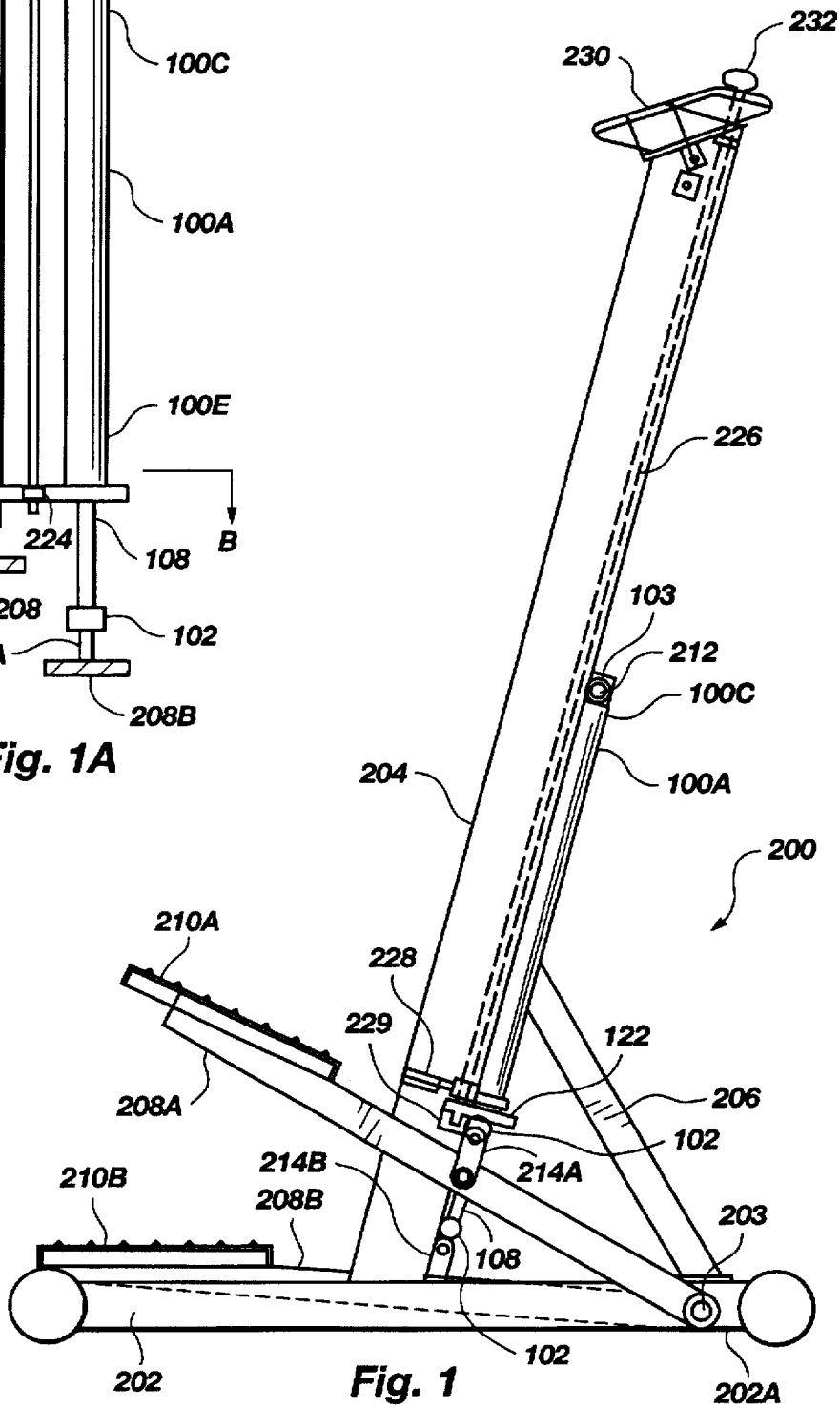
FIG. 1 is a side elevational view of a stairclimbing exercise machine including a remote resistance adjustment means of the invention.

FIG. 1 depicts a stairclimbing-type exercise machine or stepper incorporating hydraulic cylinders as more fully described hereinafter. The machine has a frame indicated generally at 200 that includes a base 202 which rests on the floor or other support surface and an upright member 204 which is attached to and extends upward from the base 202. An angled support 206 is attached to and extends between the upright member 204 and the base 202. A right pedal or lever 208A and a left pedal or lever 208B are each pivotingly attached proximate one end 202A of the base 202 to rotate about axle 203. A right foot support 210A is attached to the right lever 208A; and a left foot support 210B is attached to the left lever 208B.

A crossbar 212 is attached to the upright member 204. A left hydraulic cylinder 100A and a right hydraulic cylinder 100B each have distal ends 100C and 100D attached to the crossbar 212 on one side of upright member 204. The proximal ends 100E and 100F of the cylinders 100A and 100B are attached to levers 208A and 208B respectively by a strap 214A.

As better seen in FIG. 1A, the second hydraulic cylinder 100B is similarly attached to the other lever 208B by bracket 214B. The second cylinder 200B is also attached to the crossbar 212 on the side of upright member 204 generally in alignment with the first cylinder 100A. The attachment of brackets 214A, 214B to the cylinders 100 and to the pedal levers 208A, 208B, is such that brackets 214A, 214B are free to pivot at both attachment points. Such pivoting is needed to accommodate the arc traversed by the levers 208A,B as they move. In both FIG. 1 and 1A, the cylinder 100A attached to the lowered pedal lever 208B is shown in the extension or down stroke or phase while the cylinder 100B attached to the raised pedal lever 208A is shown in the retraction stroke (also referred to as contracted or contraction phase, or at-rest position).

Figure 1B:
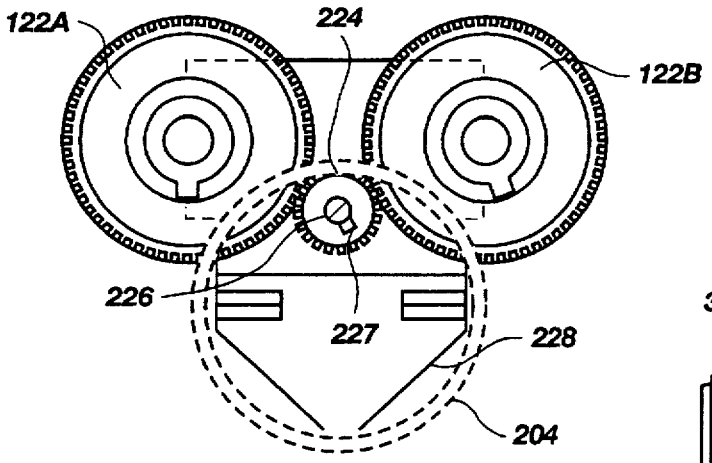
FIG. 1B is a detail view of the cylinders and motor assembly taken along lines B—B in FIG. 1A.

As better seen in FIG. 1B, a gear 224 is disposed to simultaneously engage the transmission collars 122A and 122B of both cylinders 100A and 100B. A bracket 228 is mounted to the upright member 200, and is configured to hold both cylinders 100 and the gear 224 in the indicated arrangement.

Figure 2B:
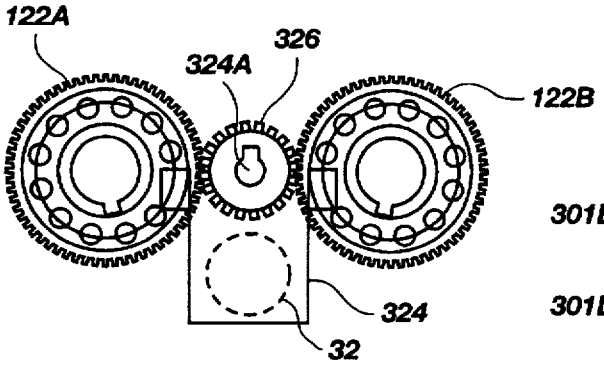
FIG. 2B is a detail view of the cylinders and motor assembly taken along lines B—B in FIG. 2A.
Figure 2A:
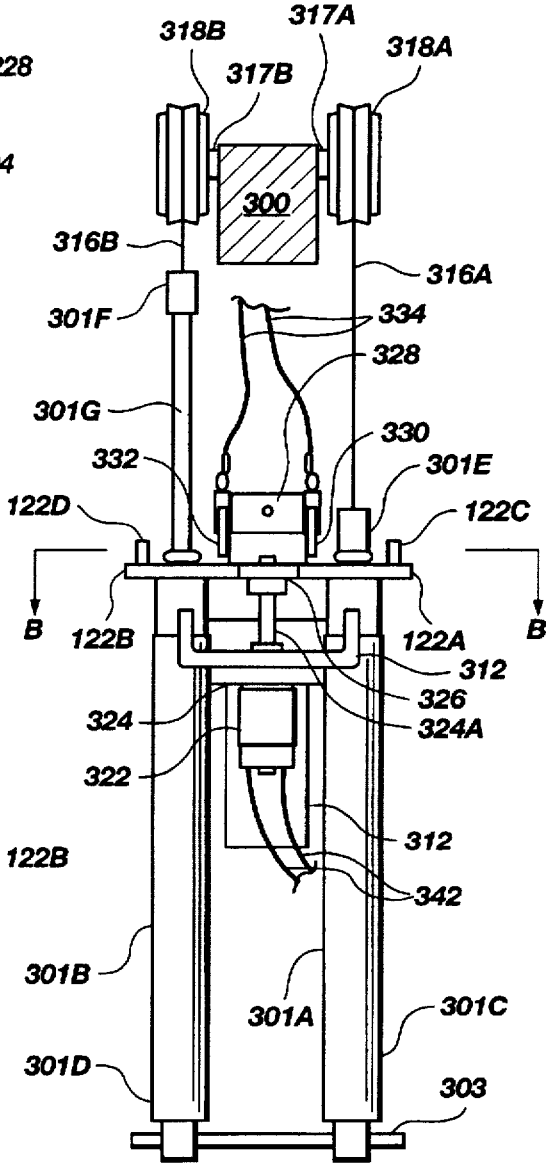
FIG. 2A is a detail top view of the variable resistance cylinders, motor assembly, pulley wires and pulleys of the stairclimbing exercise machine in FIG. 2.
Figure 2:
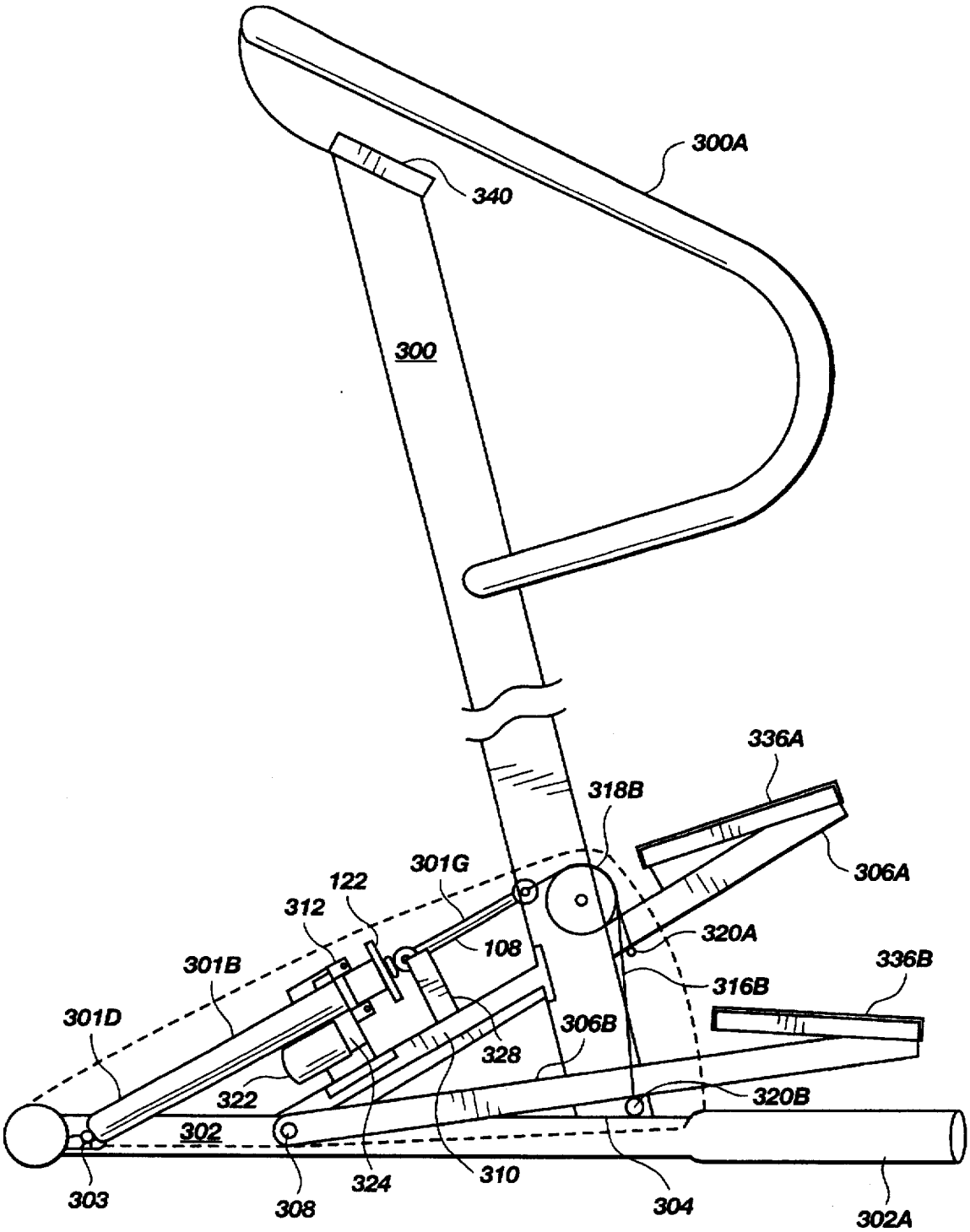
FIG. 2 is a side elevational view of an alternate embodiment of a stairclimbing exercise machine having a remote resistance adjustment mechanism.

In the illustrated embodiment, the upright member 200 has a notch 229 formed therein to accommodate the bracket 228, the transmission collars 122A and B, and the gear 224 (FIG. 1). The gear 224 is mounted on a rod 226 by a key 227. The rod 226 extends upward along the upright member 200 to a console 230 mounted thereon (FIG. 2). Alternately a transmission cable (comparable to a speedometer cable) may be used in lieu of rod 226. Further, a friction disc may be used to rotate the collar in some applications.

The rod 226 has a crank or knob 232 operably attached to its upper end 226A by conventional means. Alternatively the knob or crank 232 may be linked to the rod 226 by a second gear assembly including a gear affixed to the upper end 228 (not shown). By turning the knob 232, the user rotates the gear 224 and thus the transmission collars 122A and 122B of both cylinders, adjusting the resistance thereof.

Figure 3:
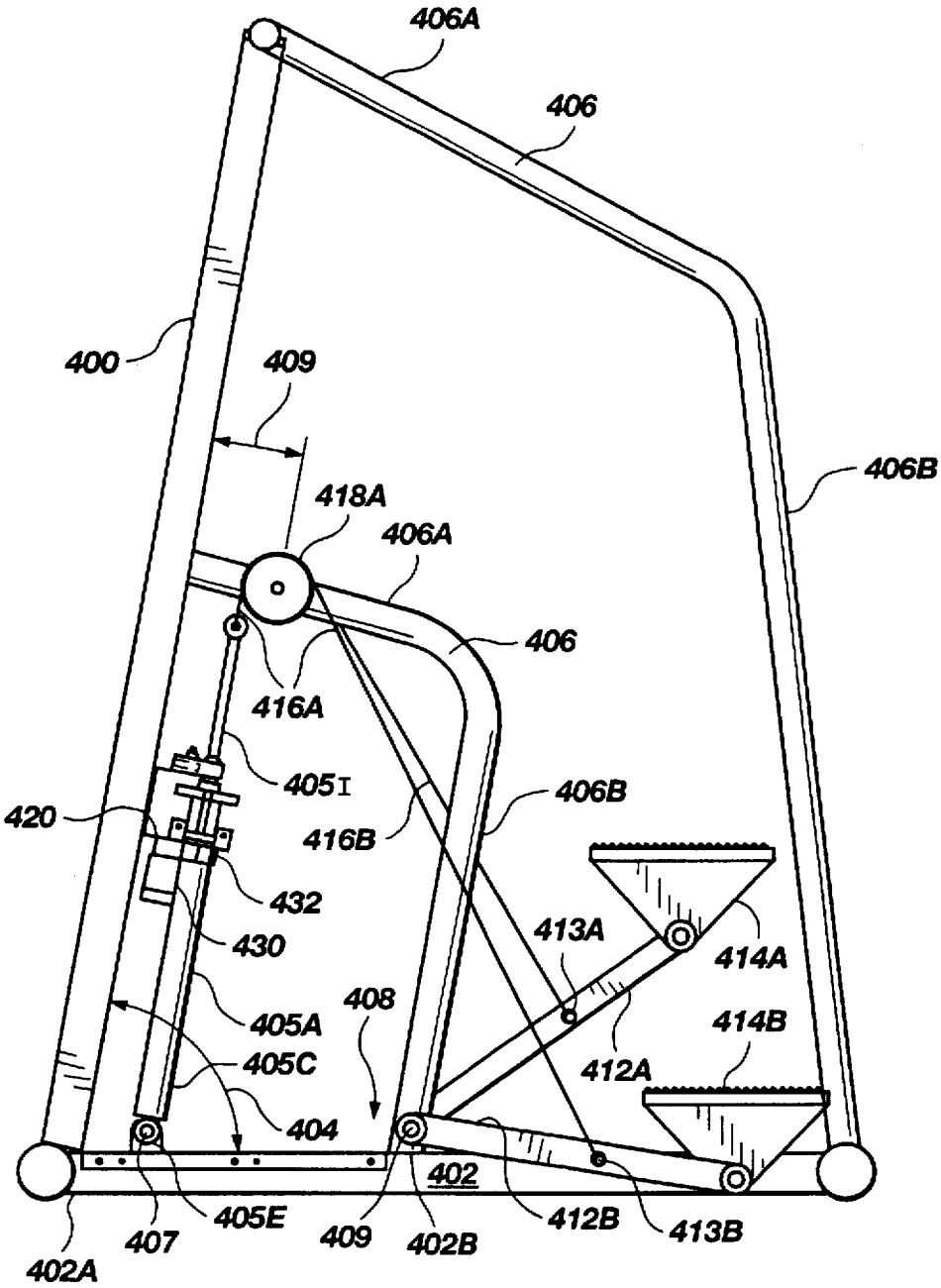
FIG. 3 is an elevational view of a second alternate embodiment of a stairclimbing exercise machine of the invention.

An alternate embodiment of an exercise machine incorporating an adjustable fluid flow cylinder with a gear drive means, but having a motorized remote drive linkage, is depicted in FIGS. 2 and 3. These embodiments also are stairclimbing exercise machines with two hydraulic cylinders, each linked to the respective pedals or levers by a vertically offset pulley.

In the embodiment of FIG. 2, an upright member 300 extends upward from a point 304 which is located towards the proximal end 302A of a base 302. A handle 300A is attached to the upright member 300. A right pedal or lever 306A and a left pedal or lever 306B are each pivotally mounted on opposite sides of the base 302 to rotate about axle 308 which is forward of point 304. The pedal levers 306A and 306B thus extend past the upright member 300 on opposing sides thereof. An angled support member 310 is mounted to the base 302 at point 304 and to the upright member 300 to support the upright member 300.

Resistance elements, which are here exemplified as a right hydraulic cylinder 301A and left hydraulic cylinder 301B have their respective distal ends 301C and 301D attached near the forward end 302B of the base (FIG. 2, FIG. 2A) to rotate about an axle or pin 303. A bracket 312 is affixed about both cylinders 301A and 301B and to the angled member 310. The bracket 312 firmly holds the cylinders 301A and 301B in an orientation which is generally in alignment with the angled member 310 as shown. The terminal bushings 301E and 301F of the cylinders 301A and 301B are each connected to respective pulley wires 316A, 316B, which in turn pass over guides which are here shown as pulleys 318A, 318B (FIG. 2A) and connect to pins 320A and 320B attached to the undersides of the pedal levers 306A, 306B, respectively.

Pulleys 318A, 318B are rotatably mounted to pins 317A and 317B which extend on opposite sides from the upright member 300. In FIG. 2A, one of the hydraulic cylinders 301B is shown in an extension stroke with the piston shaft 301G pulled out. That is the left cylinder 301B is attached to the lowered pedal lever 306B and has the shaft 301G extended so the cable or pulley wire 316A is extended over the pulley 318B. The right cylinder 301A is attached to the raised pedal lever 306A and is in a contraction stroke with the pulley wire 316A forward of the pulley 318A.

A motor 322 is mounted to the bracket 312 proximate the cylinders 301A and 301B. A gearbox 324 is operably associated with the motor 322 to provide an output rotation of a desired or selected revolutions per minute (RPM) and torque. Motor shaft 324A extends from the gearbox 324 and has a gear 326 affixed at one end to rotate synchronously therewith. The bracket 312 is configured to hold the cylinders 301A and 301B, motor 322 and gearbox 324 positioned such that gear 326 engages simultaneously with the collars 122A and 122B of both cylinders 301A and 301B. A cutoff switch bracket 328 is mounted to the angled support 310 and engages with the collars 122A and 122B for limiting the rotation of the collars relative to the bearing 130.

A keypad 340 or other means to send electrical "on" and "off" signals is mounted near the upper end of the upright member 300. The keypad 340 is communicatively connected by wires 342 to the motor 322 to power the motor to rotate either clockwise or counterclockwise based on the polarity of the electrical signal. Electrical power is supplied to the pad 340 by a separate cord (not shown) connectable to an electrical outlet. By appropriate operation of the keypad 340, a user can cause the motor to rotate to in turn rotate collars 122A and 122B clockwise and counterclockwise to vary the resistance to movement of the pedals 306A and 306B.

In FIG. 2A, it can also be seen that each collar 122A and 122B has a toggle 122C and 122D attached to rotate with the collar 122A and 122B to in turn contact limit switches 330 and 332. Upon actuation, limit switches 330 and 332 deactivate the motor 322 and limit movement in both the clockwise and counterclockwise direction. The limit switches 330 and 332 are connected to the keypad 340 by wires 334. Relays or other electrical components can be used in the keypad 340 is interrupt the electrical flow to the motor 322.

Alternatively, the motor 322 and gearbox 324 could be replaced with a rigid rod like that of the embodiment of FIG. 2, extending upward through the gear 326 to terminate in a dial located on a console or the like. The dial may be connected to the rod such that rotation of the dial is translated to rotation of gear 326 to adjust the resistance. In another embodiment, the motor could be replaced with a crank connected to gear 326. The crank could be used to adjust the resistance. Alternately the resistance of the two cylinders could be separately adjusted by manual rotation of the collars 122. It is also within contemplation that the cylinders 301A and 301B could each be provided with separate gears and motors or mechanical adjustment rods (not shown), the two gears thus providing independent adjustment of the resistance of the cylinders 301A and 301B. Such an arrangement may be suitable for use in a physical therapy setting, where an injured and weaker leg is undergoing rehabilitation to match the uninjured leg.

The stairclimbing machine of FIG. 3 has levers 306A and 306B attached to the base 302 at a position forward of the upright member 304. However, the foot support 336A and 336B are disposed to the rear of the upright member 300 to provide for stability and to provide relatively compact dimensions from front to rear. Also, fluid cylinders 301A and 301B are in general alignment with the axis 303 below the pulleys 318A and 318B to provide for a slim vertical profile and for a comparatively low center of gravity of the apparatus, which in turn results in enhanced stability.

In FIG. 3, an exercise machine has an upright member 400 which extends upward from one end 402A of a base 402, at an angle 404 with respect to the base of about 80 degrees. A frame element 406 has a first segment 406A which is attached to extend forward from the upright member 400, and a second segment 406B which is attached to extend upward from a point 402B partway along the base 402, to join frame segment 406A.

As better seen in FIG. 3, a crossmember 408 is mounted to frame segment 406B just above the base 402, to extend crosswise to both left and right sides of segment 406B. A right pedal or lever 412A and a left pedal or lever 412B are each pivotingly attached to crossmember 408 on opposing sides of the frame segment 406B to rotate about axle 409. Foot supports 414A and 414B are pivotingly mounted to the free ends of the pedal levers 412A and 412B.

Resistance means which are here exemplified as hydraulic cylinders 405A and 405B each have the distal end 405C and 405D mounted to the base 402 to rotate about a base axis 407. Hydraulic cylinders 405A and 405B have their lower bushings 405E and 405F connected to base 402. The terminal bushing 405G and 405H are connected to pulley wires 416A and 416B, which in turn pass over pulleys 418A and 418B and eventually connect to the levers 412A, 412B at pins 413A and 413B.

Figure 3A:
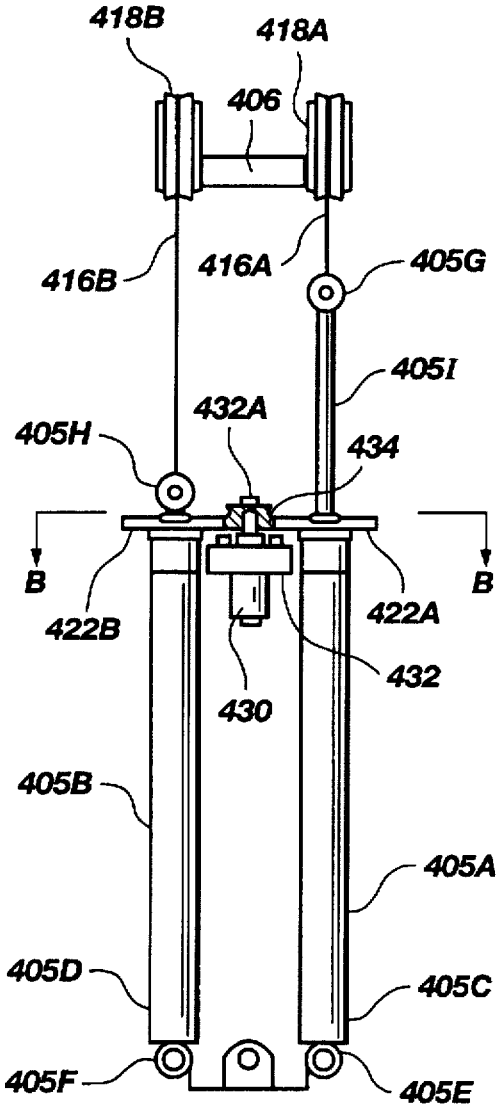
FIG. 3A is a detail showing the variable resistance cylinders, motor assembly, pulley wires and pulleys of the stairclimbing exercise machine in FIG. 3.
Figure 4:
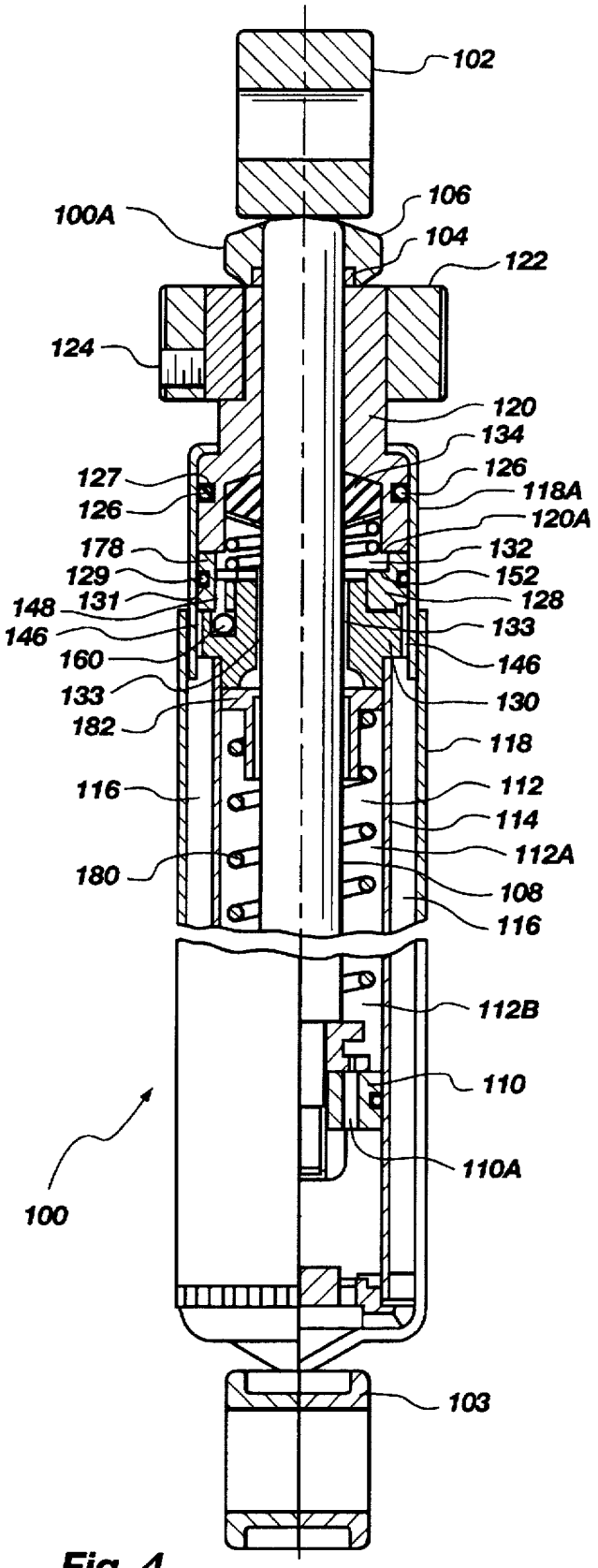
FIG. 4 is a side view of a variable resistance hydraulic cylinder of the type useful with the invention, shown in partial cross-section and cutaway.

A bracket 420 is attached to the upright member 400, and to the upper ends of the hydraulic cylinders 405A and 405B to hold them in alignment along the upward member 400. Pulleys 418A and 418B are mounted on opposing sides of the frame segment 406A at a distance 409 from the upright member 400 such that the force on the pulley wires 416A and 416B is exerted along the respective axes defined by the piston rods such as rod 405I of the hydraulic cylinders 405A and 405B. As shown in FIGS. 3 and 3A, hydraulic cylinder 405A is in an extension stroke with the piston rod 405I extended (the cylinder attached to the lowered pedal lever 412B in FIG. 4). The other cylinder is shown in a contraction stroke.

Figure 3B:
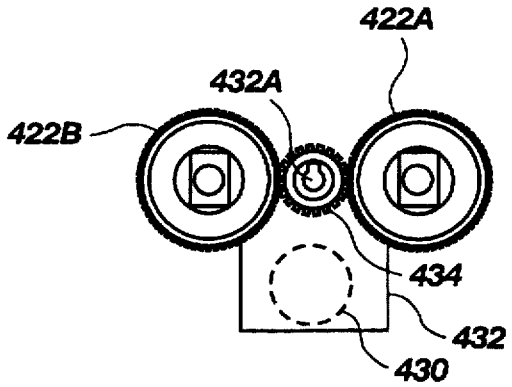
FIG. 3B is a detail top view of the cylinders and motor assembly taken along lines B—B in FIG. 3A.

A motor 430 is mounted to the bracket 420 adjacent the two hydraulic cylinders. As better seen in FIGS. 3A and 3B, a gearbox 432 with a motor shaft 432A is operably associated with the motor 430 for converting the rotatory output of the motor to an output with preferred torque and rate of rotation (rpm) parameters. A central gear 434 is fixed to the motor shaft 432A to rotate synchronously therewith. Gear 434 is positioned to simultaneously engage with the transmission bushings 422A and 422B (see FIG. 3) of both of the hydraulic cylinders 100. Thus, rotation of the motor shaft 432A is translated to synchronous corresponding rotation of the collars 422A and 422B and transmission bushings 405G and 405H of both the hydraulic cylinders 405A and 405B, thereby simultaneously adjusting the resistance of both cylinders.

Thus, similar to the embodiment of FIG. 2, rotation of the motor shaft 432A translates to synchronous corresponding rotation of the collars 422A and 422B and thereby adjusts the resistance of both cylinders 405A and 405B.

The embodiment of FIG. 3 is similarly provided with a keypad or the like communicatively connected to the motor 430. Similarly limit switches are provided to regulate rotation of the collars 422A and 422B. Alternate embodiments of resistance adjustment as described previously in regard to FIG. 2 are equally applicable to the embodiment of FIG. 3.

With further respect to the embodiments of FIGS. 2 and 3, it will be apparent that the hydraulic cylinders 100 may be replaced or supplemented with alternate resistance elements.

Another type of adjustable resistance fluid cylinder uses a variable flow rate valve disposed in a channel which limits the flow rate to define the cylinder resistance (see U.S. Pat. Nos. 4,979,736 (Maynard) and 5,190,505 (Dalebout, et al.) for examples of such cylinders). An alternate embodiment of an exercise machine with remotely adjustable cylinder resistance employs this type of cylinder, wherein the variable flow valve is an electrically actuated variable flow valve, such as a solenoid valve. In this embodiment, the remote resistance adjustment means comprises an electronic controller communicatively linked to control the valve flow rate.

The remote resistance adjustment means described herein can also be readily adapted for use with other stairclimbing-type exercise machines using fluid cylinders as resistance elements, such as those disclosed in U.S. Pat. No. 5,190,505 (the disclosure of which is hereby incorporated by reference).

Figure 4A:
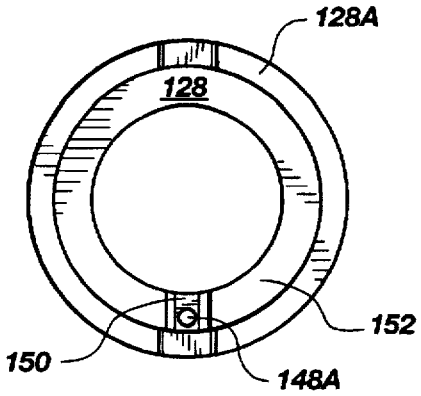
FIG. 4A is a top planar view of one component of the hydraulic cylinder in FIG. 4.

As seen in FIG. 4A, a hydraulic cylinder 100 has a terminal bushing 102 which serves to connect the proximal end 100A to an exercise machine structure (not shown). The distal end 100B is similarly provided with attachment means 103 for attachment to an exercise machine structure. Typically in an exercise machine having a support frame and a movable member attached thereto for movement by a user in the performance of exercises, one of the ends 100A, 100B is pivotally connected to the frame and the other end is pivotally connected to the movable member, such that the hydraulic cylinder provides resistance to the movement of the movable member. Desirably, a spacer 104 and a cushion 106 made out of an elastic-like material are provided, for cushioning contact between the bushing 102 and other components of the cylinder 100.

The cylinder 100 has an inner chamber 112 defined by inner wall 114, and an outer chamber 116 defined by the inner wall 114 and an outer wall 118. A piston shaft 108 has one end connected to the bushing 102 and terminates in a piston head 110 at the other end; both the shaft 108 and the piston head 110 are disposed within the inner chamber 112. An acceptable hydraulic fluid, such as oil, is disposed within both the inner and outer chambers 112, 116.

A transmission fitting 120 is mounted about the proximal end 108A of the shaft 108, and a collar 122 is secured to the transmission fitting 120 by a set screw 124.

In place of the set screw 124, the collar 112 may be secured by friction fit, key way locking or other suitable means. The transmission fitting is sealed against the outer wall 118 by an "o" ring 126 seated in a groove 127. An axle bushing 128 is affixed to the lower edge 120A of the transmission fitting 120, for example by mating of lugs formed on the transmission fitting with corresponding slots formed on the adjacent surface of the axle bushing 128 (not shown). The axle bushing 128 is also sealed against the outer wall 118, by an "o" ring 129 in a groove 131. A bearing 130 is mounted about the shaft 108 below and adjacent the axle bushing 128.

Together, the interior surfaces of transmission fitting 120, axle bushing 128 and bearing 130 define a reservoir 132. An oil seal 134 is disposed in the reservoir 132 to prevent oil from seeping between the transmission fitting 120 and the shaft 108, and a spring 136 holds the seal 134 firmly in position. Bearing 130 is mechanically fixed to the inner wall 114, and does not rotate, while the axle bushing 128 and transmission fitting 120 are free to rotate within the segment 118A of the outer wall in which they are enclosed.

Bearing 130 is formed with one or more slots 133 extending along shaft 108, to provide fluid communication between the reservoir 132 and the inner chamber 112. Additionally, the assembly comprising the transmission fitting 120, axle bushing 128 and bearing 130 is configured with an interior channel providing fluid communication between reservoir 132 and outer chamber 116, the interior channel being described subsequently with reference to FIGS. 4B, 4C and 4D.

In an extension stroke, piston shaft 108 is pulled outward in the direction indicated by arrow 158 through the opening 120B in the transmission fitting 120. It will be apparent that during such extension stroke, the piston head 110 moves toward the bearing 130 and oil is forced from the inner chamber 112 through slot 133 into the reservoir 132. In turn, oil is forced out of reservoir 132 through the interior channel, into the exterior chamber 116. Conversely, during a contraction phase the piston shaft 108 slides back into the cylinder and the piston head 110 moves toward the distal end 112B of the inner chamber 112. This movement will tend to exert a vacuum pull drawing fluid out of reservoir 132, thereby in turn causing fluid to flow back into reservoir 132 from the exterior chamber 116.

Figure 4B:
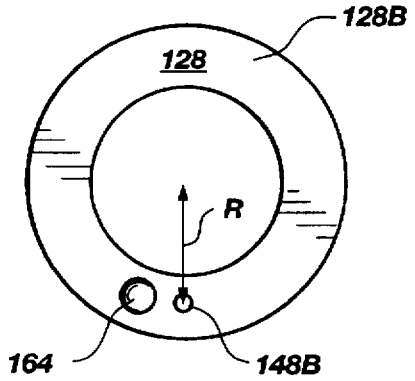
FIG. 4B is a bottom planar view of another component of the hydraulic cylinder in FIG. 4.
Figure 4C:
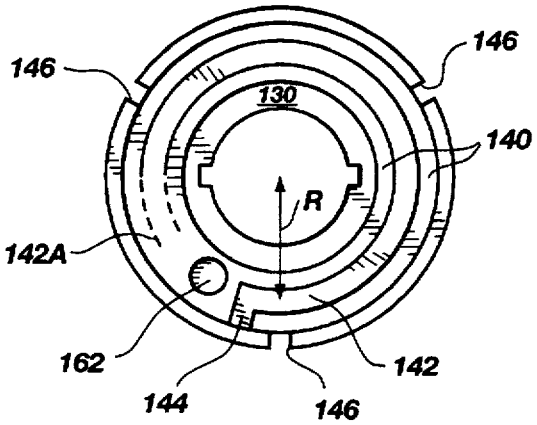
FIG. 4C is a top planar view of the component in FIG. 4B.
Figure 4D:
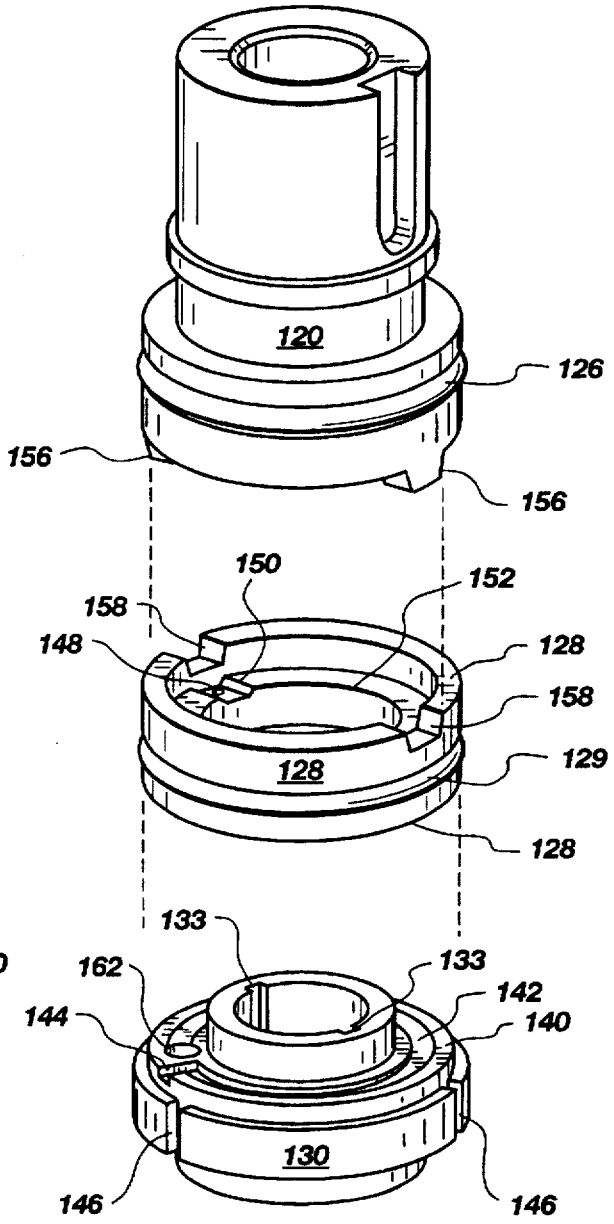
FIG. 4D is an exploded perspective view of the components shown in FIGS. 4A, 4B and 4C.

As better seen in FIGS. 4B and 4C, the upper surface 140 of bearing 130 has a semi-circular trough 142 formed therein, the trough 142 terminating at one end with an outlet segment 144 which extends radially outward through the edge of the bearing 130. As better seen in FIG. 4D, the outlet segment 144 opens into the exterior chamber 116 through outer grooves 146. The trough 142 varies in depth from a shallow end 142A to being deepest at the juncture with the outlet segment 144. When the surface 140 of the bearing 130 is positioned snugly against the lower surface (not seen) of the axle bushing 128, the trough 142 and the axle bushing together form an enclosed annular channel segment which varies in cross-section according to the depth of the trough 142.

An axle bushing orifice 148 extends between the upper and lower surfaces of the axle bushing 128 (FIG. 4B). The orifice 148 opens into a recessed radial groove 150 formed in a ledge 152 that extends along the inner circumference of the axle bushing (FIG. 4B); the orifice 148 thus opens into the reservoir 132. As better seen in FIG. 4D, the orifice 148 is located such that the lower end 148A is at substantially the same radial distance R from the shaft 108 as the trough 142; thus, the orifice 148 provides fluid communication between the annular channel and the reservoir 132.

Together, the axle bushing orifice 148, the annular channel defined by the trough 142, and the outlet segment 144 constitute an interior channel between the reservoir 132 and the outer chamber 116. The outlet segment 144, trough 142, and the axle bushing orifice 148 are dimensioned such that oil flow through the interior channel is limited by the effective cross-section of the annular channel; this effective cross-section in turn depends upon the depth of the trough 142 at the position at which the orifice 148 enters. Thus, the effective cross-section of the annular channel can be varied by rotating the rotatable member, and thus the axle bushing 128, relative to the bearing 130. The axle bushing 128 and bearing 130, including the grooves 133, orifice 148 and trough 142, are dimensioned such that the region of the interior channel which limits the flow of oil is that of the semi-circular passage defined by the trough 142. The effective cross-section of the semi-circular passage (the cross-section of the trough 142) depends upon the angular position of the axle bushing orifice 148 along trough 142.

It will be apparent that in principle, the transmission bushing 120 and the axle bushing 128 function together as a single rotatable element. In the illustrated embodiment, the rotatable element is shown as being two parts which mate together by means of lugs 156 on transmission bushing 120 and corresponding notches 158 on the axle bushing 128 (FIG. 4D), as this is presently necessitated for practical construction by metal machining.

Also, the axle bushing orifice 148 of this embodiment is a cylindrical passage of fixed radius whose inlet 148A leads from the upper surface 128A (FIG. 4A) to an outlet 148B on the lower surface 128B (FIG. 4B) of the axle bushing 128. This configuration is presently preferred for ease of conventional machining manufacture. However, the orifice 148 could be shaped differently and could have its inlet to the reservoir 132 on the inner circumference of the axle bushing 128 (or of a single rotatable element designed to replace the assembly now comprising the transmission and axle bushings), so long as it is dimensioned to provide a flow rate greater than or equal to the maximum flow rate attainable in the semi-circular trough 142.

The presently preferred embodiment further includes a ball 160 held between the lower surface of the axle bushing 128 and the upper surface of the bearing 130, and partially riding in the trough 142 during rotation of the axle bushing relative to the bearing. A ball detent 162 is formed on the surface 140 of the bearing 130, between the outlet segment 144 and the shallow end 142A of the trough 142. A similar ball detent 164 is formed on the lower surface of the axle bushing 128, located so as to register with the ball 160 when the ball is seated in the bearing ball detent 162. When the axle bushing 128 is rotated to a position relative to the bearing 130 such that the ball is registered in the detents 162, 164, the outlet is positioned over the deepest part of the trough 142, and the cylinder resistance is at its minimum.

The resistance of the cylinder can be varied by direct manual rotation of the collar 122 with the transmission fitting 120 (and thus the axle bushing 128), as by the user by gripping the outer surface of the transmission fitting. To facilitate manual operation, the outer surface of the collar 122 may be formed with "bottle cap" type grooves, extensions such as those on a wing nut, a key to be inserted in a keyway formed in the transmission fitting, a crank handle affixed to the collar 122, or the like.

For use in the present invention, the cylinder must be fitted with a gear collar configured for engagement with the gear drive means. As depicted in FIG. 4A, such means may take the form of gear means formed on the outer surface of the collar 122, for interaction with a gear linkage mechanism that can be operated by a user from a location remote with respect to the cylinder. The gear linkage mechanism may include a motor, or may be strictly mechanical. Such gear linkage mechanisms are described in greater detail subsequently herein, with respect to the exercise machines shown in FIGS. 1, 2, and 3.

The hydraulic cylinder 100 is configured generally as a single-action shock absorber. As such, the cylinder 100 further includes means operably associated with the piston head for fluid communication between the compartments 112A, 112B of the inner chamber, compartments 112A and 112B being defined by being forward of and rearward of the piston head 110. Such means for fluid communication is here shown as a passage 110A formed in the piston head 110. Also, a spring 180 is desirably disposed between the bearing 130 and the piston head 110 to bias the piston head 110 toward the contracted or retracted position. A spring bushing 182 is positioned adjacent the lower surface 130A of the bearing 130 to help hold the spring 180 in place. In the stairclimbing exercise machines of FIGS. 1, 2 and 3 which incorporate the single-action cylinders, the arrangement including spring 180 helps return the pedal lever to the elevated position, preparatory to a user stepping on the attached pedal to push the pedal lever down.

However, in other applications a double-action cylinder may be desired, in which case the spring 180 may be eliminated, and channel 110A in the piston head may be eliminated or reduced in size to limit the flow of oil on the contraction stroke.

The foregoing illustrated embodiments are for purposes of exemplification. It will be recognized that numerous variations and modifications to the illustrated embodiments can be made without departing from the concept and scope of the invention. The claims themselves define the scope of that which is regarded as the invention disclosed herein.

What is claimed is:

1. An exercise apparatus comprising:

a support structure;

lever means movably mounted to said support structure for movement by a user in the performance of exercise movements;

resistance means connected between said lever means and said support structure to resist movement of said lever means, said resistance means having external adjustment means for mechanically varying the resistance to movement of said lever means;

operation means for operating said external adjustment means, said operation means being positioned to mechanically cooperate with said external adjustment means for operating said external adjustment means; and drive means operably linked to said operation means for operation of said external adjustment means.

2. The exercise apparatus of claim 1, wherein said resistance means includes a first cylinder that has a first rod extending outwardly from a body, said first rod being connected to a piston within said body, and said body having a hydraulic fluid to resist movement of said piston and wherein said external adjustment means includes external structure operable to regulate movement of said piston and said first rod.

3. The exercise apparatus of claim 2, wherein said piston has flow regulation means to regulate the flow of said hydraulic fluid therethrough, wherein said first rod is operably connected to said piston and wherein said external structure is positioned to rotate one of said body and said first rod relative to each other to vary the flow of said hydraulic fluid through said piston.

4. The exercise apparatus of claim 2, wherein said external structure includes a first rotatable collar positioned about said body of said first cylinder; wherein said operation means includes rotation structure configured to mechanically engage said first rotatable collar for rotating said first rotatable collar about said body of said first cylinder; and wherein said drive means is operably linked to said rotation structure to rotate said rotation structure.

5. The exercise apparatus of claim 4, wherein said drive means is disposed on said support structure and connected to said rotation structure to rotate said first rotatable collar and thereby adjust the resistance to movement of said lever means.

6. The exercise apparatus of claim 5, wherein said rotation structure includes a gear and wherein said first rotatable collar is formed to mesh with said gear.

7. The exercise apparatus of claim 6, wherein said drive means includes a mechanical linkage having a first end and second end, wherein said first end is positioned proximate to and configured to operate said gear, wherein said drive means includes a knob for connection to said second end and positioned for operation by a user to cause said mechanical linkage to operate said gear.

8. The exercise apparatus of claim 2, wherein said support structure includes a base support and an upright member having a first end attached to said base support and a second end extending upward therefrom.

9. The exercise apparatus of claim 2, wherein said resistance means includes a second cylinder that has a second rod extending outwardly from a body, said second rod being connected to a piston within said body, and said body having a hydraulic fluid to resist movement of said piston and said second rod.

10. The exercise apparatus of claim 9, wherein said first cylinder has a first end through which said first rod extends and a second end secured to said support structure and wherein said second cylinder has a first end through which said second rod extends and a second end secured to said support structure.

11. The exercise apparatus of claim 1, wherein said lever means includes a first lever movably mounted to said support structure and a second lever movably mounted to said support structure spaced from said first lever and wherein said resistance means includes a first resistance connected between said first lever and said support structure and a second resistance connected between said second lever and said support structure, said wherein said external adjustment means includes first external structure and second external structure for varying the resistance to movement of said first lever and said second lever respectively, and wherein said operation means is positioned to mechanically cooperate with and to operate said first external structure and said second external structure.

12. The exercise apparatus of claim 11, wherein said first lever and said second lever are a first pedal and a second pedal respectively, wherein said first pedal and said second pedal each have a first end, wherein said first pedal and said second pedal are each rotatably mounted proximate their respective first ends to said support structure, wherein said first pedal and said second pedal each have a second end configured for the foot of a user, and wherein said first resistance and said second resistance each are interconnected between said support means and said first pedal and said second pedal respectively to resist rotational movement of said first pedal and said second pedal respectively by a foot of a user.

13. The exercise apparatus of claim 12, wherein said support structure includes an base with an upright member extending upwardly therefrom, and wherein said first ends of said first pedal and said second pedal respectively are attached to opposite sides of said upright member, and wherein said first pedal and said second pedal respectively have second ends which extend away from said upright member.

14. An exercise apparatus comprising:

a support structure;

a first lever and a second lever each movably mounted to said support structure for a user to move in the performance of exercise movements;

a first fluid cylinder and a second fluid cylinder each connected between said first lever and said second lever respectively and said support structure for offering resistance to said exercise movements of said first lever and said second lever respectively, each of said first fluid cylinder and said second fluid cylinder being configured for adjustment of resistance to movement of each of said first lever and said second lever by rotation of a collar relative to a main cylinder assembly;

gear means engaged with said collar of each of said first fluid cylinder and said second fluid cylinder for rotating each of said collars;

remote drive means operably linked to said gear means; and actuation means disposed on said support structure and connected to said remote drive means for actuating said remote drive means to operate said gear means to rotate said collar of each of said first fluid cylinder and said second fluid cylinder and to thereby adjust said resistance.

15. An exercise apparatus comprising:

a support structure;

lever means movably mounted to said support structure for movement by a user in the performance of exercise;

resistance means connected between said lever means and said support structure for resisting movement of said lever means, said resistance means having first external adjustment means for varying the resistance to movement of said lever means;

operation means positioned for operating said external adjustment means; and drive means operably linked to said operation means for operation of said external adjustment means by a user positioned to operate said exercise apparatus.

16. An exercise apparatus comprising:

a support structure;

lever means movably mounted to said support structure for a user to move in the performance of exercise movements;

a fluid cylinder connected between said lever means and said support structure for resisting movement of said lever means, said fluid cylinder being configured for adjustment of resistance to movement of said lever means by rotation of a collar relative to a main cylinder assembly;

gear means engaged with said collar for rotating said collar;

remote drive means operably linked to said gear means; and actuation means disposed on said frame and connected to said remote drive means for actuating said remote drive means to operate said gear means to rotate said collar and thereby adjust said resistance.

17. An exercise apparatus comprising:

a support structure;

lever means movably mounted to said support structure for movement by a user in the performance of exercise movements;

resistance means connected between said lever means and said support structure to resist movement of said lever means, said resistance means having external adjustment means for mechanically varying the resistance to movement of said lever means, said resistance means including a first cylinder that has a first rod extending outwardly from a body, said first rod being connected to a piston within said body, and said body having a hydraulic fluid to resist movement of said piston, said external adjustment means being operable to regulate movement of said piston and said first rod, said piston including flow regulation means to regulate the flow of said hydraulic fluid therethrough, said first rod being operably connected to said piston, and said external adjustment means being positioned to rotate one of said body and said first rod relative to each other to vary the flow of said hydraulic fluid through said piston;

operation means for operating said external adjustment means, said operation means being positioned to mechanically cooperate with said external adjustment means for operating said external adjustment means; and drive means operably linked to said operation means for operation of said external adjustment means.

18. An exercise apparatus comprising:

a support structure;

lever means movably mounted to said support structure for movement by a user in the performance of exercise movements;

resistance means connected between said lever means and said support structure to resist movement of said lever means, said resistance means having external adjustment means for mechanically varying the resistance to movement of said lever means, said resistance means including a first cylinder that has a first rod extending outwardly from a body, said first rod being connected to a piston within said body, said body having a hydraulic fluid to resist movement of said piston and said external adjustment means being operable to regulate movement of said piston and said first rod, said body being a double-walled cylinder having first and second ends and an inner wall defining a hollow interior containing said hydraulic fluid and said piston slidably disposed therein and an outer wall enclosing said inner wall and defining a space between said inner and outer walls, said piston rod have a first end terminating in a piston head, and a second end extending sealingly and slidably through said cylinder second end, said first cylinder including a bearing member of annular shape mounted over said piston shaft, fixed to said inner tube wall adjacent said cylinder second end, said bearing member having a semi-circular trough formed thereon, said trough having a depth which varies with angular distance about said piston shaft, from a minimum depth at a starting angular location to a maximum depth at a terminal angular location, and said bearing member including an outlet segment located at said terminal angular location for communicating between said space and said trough, said first cylinder further including a rotatable member of annular shape rotatable about said piston shaft relative to said bearing member, and configured to form a reservoir adjacent said piston shaft, said reservoir receiving fluid from said interior of said inner cylinder, and said rotatable member having an internal orifice with an outlet radially located to communicate with said semi-circular trough and an inlet communicating with said reservoir, and said first cylinder including means operably associated with said rotatable member for rotating said rotatable member to position said outlet at a desired angular location along said trough;

operation means for operating said external adjustment means, said operation means being positioned to mechanically cooperate with said external adjustment means for operating said external adjustment means; and drive means operably linked to said operation means for operation of said external adjustment means.

19. The exercise apparatus of claim 2, wherein:

said body is a double-walled cylinder having first and second ends, and includes an inner wall defining a hollow interior containing a fluid and an outer wall enclosing said inner wall and defining a space between said inner and outer walls;

said piston is slidably disposed within said hollow interior;

said piston shaft has a first end terminating in a piston head, and a second end extending sealingly and slidably through said cylinder second end;

a bearing member of annular shape mounted over said piston shaft, fixed to said inner tube wall adjacent said cylinder second end, and having a semi-circular trough formed thereon, said trough having a depth which varies with angular distance about said piston shaft, from a minimum depth at a starting angular location to a maximum depth at a terminal angular location, and including an outlet segment located at said terminal angular location for communicating between said space and said trough;

a rotatable member of annular shape disposed contactingly adjacent said first member, rotatable about said piston shaft relative to said bearing member, and configured to form a reservoir adjacent said piston shaft, said reservoir receiving fluid from said interior of said inner cylinder, and said rotatable member having an internal orifice with an outlet radially located to communicate with said semi-circular trough and an inlet communicating with said reservoir; and means operably associated with said rotatable member for rotating said rotatable member to position said outlet at a desired angular location along said trough.

* * * * *